US007854494B2

(12) United States Patent
Takahashi

(10) Patent No.: US 7,854,494 B2
(45) Date of Patent: Dec. 21, 2010

(54) NOZZLE PLATE, METHOD OF MANUFACTURING NOZZLE PLATE, AND IMAGE FORMING APPARATUS

(75) Inventor: Shuji Takahashi, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 436 days.

(21) Appl. No.: 12/023,984

(22) Filed: Jan. 31, 2008

(65) Prior Publication Data

US 2008/0186356 A1 Aug. 7, 2008

(30) Foreign Application Priority Data

Feb. 2, 2007 (JP) ..... 2007-024684

(51) Int. Cl.
*B41J 2/14* (2006.01)

(52) U.S. Cl. ..... 347/47; 347/71

(58) Field of Classification Search ..... 347/40, 347/43, 47, 70–71

See application file for complete search history.

(56) References Cited

U.S. PATENT DOCUMENTS

| | | | | |
|---|---|---|---|---|
| 5,759,421 | A | 6/1998 | Takemoto et al. | |
| 6,126,269 | A | 10/2000 | Takemoto et al. | |
| 7,273,267 | B2 * | 9/2007 | Yokouchi et al. | 347/70 |
| 7,677,690 | B2 * | 3/2010 | Takatsuka | 347/27 |

FOREIGN PATENT DOCUMENTS

| | | | |
|---|---|---|---|
| JP | 7-125220 | A | 5/1995 |

* cited by examiner

*Primary Examiner*—Lamson D Nguyen
(74) *Attorney, Agent, or Firm*—Birch, Stewart, Kolasch & Birch, LLP

(57) ABSTRACT

The nozzle plate has a nozzle hole formed therethrough, the nozzle hole being defined in the nozzle plate with an inner surface including a first liquid-philic portion, a liquid-phobic portion and a second liquid-philic portion that are arranged in this order from a side near the nozzle mouth, the first and second liquid-philic portions having liquid-philicity, the liquid-phobic portion having liquid-phoblicity.

6 Claims, 15 Drawing Sheets

NOZZLE PLATE, METHOD OF MANUFACTURING NOZZLE PLATE, AND IMAGE FORMING APPARATUS

BACKGROUND OF THE INVENTION

1. Field of the Invention

The present invention relates to a nozzle plate, a method of manufacturing a nozzle plate, and an image forming apparatus, and more particularly, to a nozzle plate and a method of manufacturing a nozzle plate used for the ejection surface of a print head of an inkjet type of image forming apparatus, or the like.

2. Description of the Related Art

An image forming apparatus of an inkjet type has been commonly known which includes a print head provided with a nozzle plate in which a plurality of nozzles are formed. The nozzle plate has an ejection surface that opposes the recording medium. The nozzle plate is typically provided with a liquid-phobic film on the ejection surface opposing the recording medium, in order to stabilize the ejection direction and improve the ejection performance of the ink droplets.

Here, if a liquid-phobic film is formed only on the ejection surface which opposes the recording medium, then the meniscus of the ink inside the nozzles is positioned in the vicinity of the ejection surface or at an indeterminate position inside the nozzle. Therefore, if the meniscus of the ink inside the nozzle is positioned in the vicinity of the ejection surface, then fine dust present outside the nozzle hole, and paper fibers generated from the recording medium, and the like, are liable to adhere to the ink inside the nozzle. Furthermore, if the meniscus of the ink inside the nozzle is situated at an indeterminate position inside the nozzle, then it becomes difficult to control the position of the meniscus and it is difficult to achieve a uniform meniscus position in all of the nozzles. Consequently, the ejection state of the ink droplets varies for each nozzle, and there is a possibility that this will lead to decline in the ejection performance of the ink droplets.

Japanese Patent Application Publication No. 7-125220 discloses a nozzle plate and a method of manufacturing a nozzle plate. FIG. 13 is an enlarged view of the vicinity of a nozzle 224 in the nozzle plate disclosed in Japanese Patent Application Publication No. 7-125220. As shown in FIG. 13, the nozzle plate described in Japanese Patent Application Publication No. 7-125220 is constituted of a nozzle plate substrate 230 having an ejection surface 230A that is covered with a liquid-phobic film 227 and opposes the recording medium. Moreover, a portion of the inner surface of the nozzle 224 is also covered with the liquid-phobic film 227.

FIGS. 14A to 14D are diagrams showing a method of manufacturing the nozzle plate described in Japanese Patent Application Publication No. 7-125220. As shown in FIG. 14A, firstly, a photosensitive resin film 228 is pressure bonded to the rear surface 230B of a nozzle plate substrate 230 (the ink droplet ejection surface being taken as a front surface 230A).

Next, as shown in FIG. 14B, the photosensitive resin film 228 is cured by radiating ultraviolet light on both the front surface 230A and the rear surface 230B of the nozzle plate substrate 230, whereupon a eutectic plated layer 225 is formed on the front surface 230A of the nozzle plate substrate 230. In so doing, as shown in FIG. 14C, a portion of the eutectic plating 225 enters inside the nozzle 224, but the amount of plating entering in this fashion is restricted by the photosensitive resin film 228 having been cured in the step shown in FIG. 14B. Thereupon, as shown in FIG. 14D, the photosensitive resin film 228 which is present on the rear surface 230B of the nozzle plate substrate 230 and has entered inside the nozzle 224 is dissolved and removed with a solvent, whereupon the nozzle plate is heated. Consequently, the ink-repelling plated layer is obtained on the front surface 230A of the nozzle plate substrate 230 and inside the nozzle 224.

However, the invention described in Japanese Patent Application Publication No. 7-125220 involves the following problems.

In the invention in Japanese Patent Application Publication No. 7-125220, the liquid-phobic film 227 is formed on the front surface of the nozzle plate substrate 230 and the inner surface of the nozzles 224. Therefore, if excessive pressure is applied to the ink inside the nozzle 224 to perform refilling of the ink into the print head (not illustrated), or the like, and the meniscus consequently breaks down, then there is a possibility that ink may flow out from the position of the boundary of the liquid-phobic film 227 inside the nozzle 224, onto the front surface 227A of the nozzle plate, thus leading to deterioration in the ink droplet ejection characteristics.

Moreover, in cases where a minute vibration is applied to the meniscus in order to prevent problems such as blockages caused by increased viscosity of the ink in the vicinity of the nozzle 224 due to a prolonged period without ejection of ink droplets, then it is difficult to maintain the meniscus position in a stable state, and there is a possibility that this will lead to deterioration in the ink droplet ejection characteristics.

Furthermore, the amount of liquid-phobic film 227 which enters into the nozzle 224 is controlled by adjusting the amount of the photosensitive resin film 228 to enter inside the nozzle 224 and become cured. However, due to the effects of the error in the accuracy of the opening section of the nozzle 224, and the effects of the wetting properties of the interior of the nozzle 224, the amount by which the photosensitive resin film 228 enters into the nozzle 224 varies, and the amount by which the liquid-phobic film 227 enters into the nozzle 224 also varies accordingly. Consequently, it is difficult to accurately control the position at which the meniscus is held inside the nozzle 224, and there is a possibility that this will lead to deterioration of the ink droplet ejection characteristics.

SUMMARY OF THE INVENTION

The present invention has been contrived in view of the foregoing circumstances, an object thereof being to provide a nozzle plate, a method of manufacturing a nozzle plate, and an image forming apparatus whereby the ink droplet ejection characteristics can be improved, by accurately controlling the position of the meniscus inside the nozzles.

In order to attain the aforementioned object, the present invention is directed to a nozzle plate having a nozzle hole formed through the nozzle plate, the nozzle hole having a nozzle mouth from which a liquid is ejected, the nozzle hole being defined in the nozzle plate with an inner surface including a first liquid-philic portion, a liquid-phobic portion and a second liquid-philic portion that are arranged in this order from a side near the nozzle mouth, the first and second liquid-philic portions having liquid-philicity, the liquid-phobic portion having liquid-phobicity.

In the present specification, the term "liquid-philic" means "having an affinity for the liquid (e.g., ink)", and the antonymous term "liquid-phobic" means "lacking an affinity for the liquid (e.g., ink)". Also, "a surface having liquid-philicity" means that the surface has an affinity for the liquid, and "a surface having liquid-phobicity" means that the surface lacks an affinity for the liquid. In other words, a liquid-philic surface (i.e., a surface having liquid-philicity) means that the surface is wettable with the liquid, and a liquid-phobic surface (i.e., a surface having liquid-phobicity) means that the surface is non-wettable with the liquid. Moreover, "liquid-philizing" a surface means to make the surface "liquid-philic", and "liquid-phobizing" a surface means to make the surface "liquid-phobic".

In this aspect of the present invention, the position of the meniscus of the liquid inside the nozzle hole is maintained at the position of the liquid-phobic portion that is separated from the nozzle mouth (ejection surface) by the first liquid-philic portion. Consequently, it is possible to accurately adjust the position at which the meniscus of the liquid is held inside the nozzle hole, and it is possible to improve the ink droplet ejection characteristics.

Preferably, the nozzle plate is constituted of an SOT substrate including a supporting layer, an active layer, and an oxide film layer interposed between the supporting layer and the active layer; a portion of the inner surface defining the nozzle hole corresponding to the active layer serves as the first liquid-philic portion; a portion of the inner surface defining the nozzle hole corresponding to the oxide film layer is covered with a liquid-phobic member that serves as the liquid-phobic portion; a portion of the inner surface defining the nozzle hole corresponding to the supporting layer serves as the second liquid-philic portion; and a surface energy Es1 of the first liquid-philic portion, a surface energy Eh of the liquid-phobic portion and a surface energy Es2 of the second liquid-philic portion have a relationship of $Es2 \geqq Es1 > Eh$.

In this aspect of the present invention, since the SOI substrate having a supporting layer, an oxide film layer and an active layer formed to good accuracy is used, then the first liquid-philic portion, the liquid-phobic portion and the second liquid-philic portion, which respectively correspond to the layers (i.e., the active layer, the oxide film layer and the supporting layer) are formed with good accuracy. Moreover, the liquid-phobic properties of the liquid-phobic portion are stronger than those of the first liquid-philic portion and the second liquid-philic portion. Therefore, the position of the meniscus of the liquid inside the nozzle hole is controlled accurately to the position of the boundary between the second liquid-philic portion and the liquid-phobic portion which is separated from the nozzle mouth (ejection surface) by the first liquid-philic portion.

Preferably, a liquid-phobic film is formed on a surface of the nozzle plate on which the nozzle mouth opens, the liquid-phobic film having liquid-phobicity with the liquid.

In this aspect of the present invention, a liquid-phobic film is formed on the surface (i.e., the ejection surface) of the nozzle plate on which the nozzle mouth opens. Therefore, even in a case where the meniscus breaks down inside the nozzle hole and the position of the meniscus moves from a position of the liquid-phobic portion inside the nozzle hole to a position nearer to the nozzle mouth (the ejection surface), since the liquid-phobic film is formed on the ejection surface, then there is no wetting and spreading of liquid onto the ejection surface. Consequently, it is possible to improve the ink droplet ejection characteristics.

Preferably, a surface energy Es1 of the first liquid-philic portion, a surface energy Eh of the liquid-phobic portion, a surface energy Es2 of the second liquid-philic portion and a surface energy Eo of the liquid-phobic film on the ejection surface have a relationship of $Es2 \geqq Es1 > Eh \geqq Eo$.

In this aspect of the present invention, the surface energy Eo of the liquid-phobic film on the ejection surface is equal to or lower than the surface energy Eh of the liquid-phobic portion on the inner surface defining the nozzle hole. Therefore, even in a case where the meniscus breaks down inside the nozzle hole and the position of the meniscus moves from a position of the liquid-phobic portion inside the nozzle hole to a position nearer to the ejection surface, wetting and spreading of liquid onto the ejection surface is not liable to occur. Consequently, it is possible to improve the ink droplet ejection characteristics.

Preferably, the inner surface defining the nozzle hole includes a plurality of the liquid-phobic portions; and one of the liquid-phobic portions which is nearest to the nozzle mouth has a surface energy lower than any other of the liquid-phobic portions.

In this aspect of the present invention, there are a plurality of liquid-phobic portions, and one of the liquid-phobic portions that is nearest to the ejection surface has a surface energy lower than any other of the liquid-phobic portions. Therefore, it is possible to confine the meniscus position in the range between the plurality of liquid-phobic portions, by adjusting pressure inside the nozzle. Moreover, even if a minute vibration is applied to the meniscus, and even if a negative pressure is applied to the liquid inside the nozzle hole, it is still possible to accurately hold the meniscus of the liquid at a prescribed position inside the nozzle hole and therefore the ink droplet ejection characteristics can be improved.

In order to attain the aforementioned object, the present invention is also directed to an image forming apparatus that includes the above-described nozzle plate.

In order to attain the aforementioned object, the present invention is also directed to a method of manufacturing a nozzle plate through which a nozzle hole is formed, the method comprising the steps of: forming the nozzle hole through an SOI substrate including a supporting layer, an active layer and an oxide film layer interposed between the supporting layer and the active layer, the nozzle hole having a nozzle mouth from which a liquid is ejected, the nozzle mouth opening on a surface on the active layer of the SOI substrate; then forming a liquid-phobic film on at least an inner surface defining the nozzle hole in the SOI substrate, the liquid-phobic film having liquid-phobicity; and then removing the liquid-phobic film other than a portion of the liquid-phobic film covering a portion of the inner surface defining the nozzle hole corresponding to the oxide film layer.

In this aspect of the present invention, the nozzle plate which is thus manufactured enables the position of the meniscus of the liquid inside the nozzle hole to be maintained at a position of the liquid-phobic film (liquid-phobic portion) having been left on the inner surface defining the nozzle hole corresponding to the oxide film layer, the liquid-phobic portion being separated from the nozzle mouth (ejection surface) by the active layer. Consequently, it is possible to accurately control the position at which the meniscus of the liquid is maintained inside the nozzle hole and it is possible to improve the ink droplet ejection characteristics.

Preferably, in the step of removing the liquid-phobic film, the SOI substrate is subjected to a removing liquid so that the liquid-phobic film other than the portion of the liquid-phobic film on the portion of the inner surface defining the nozzle hole corresponding to the oxide film layer is removed.

In this aspect of the present invention, the liquid-phobic film is left remaining only on the oxide film layer, due to the large coupling force between the oxide film layer and the liquid-phobic film, when the SOI substrate in which the liquid-phobic film has been formed on at least the inner surface defining the nozzle hole is subjected to the removing liquid. The nozzle plate can thus be manufactured simply.

In order to attain the aforementioned object, the present invention is also directed to a method of manufacturing a nozzle plate through which a nozzle hole is formed, the method comprising the steps of: forming a first opening in an SOI substrate that includes a first active layer, a second active layer, a supporting layer, a first oxide film layer interposed between the first active layer and the second active layer, a second oxide film layer interposed between the second active layer and the supporting layer, by etching the first active layer, the first oxide film layer and the second active layer; forming a first liquid-phobic film on at least an inner surface defining the first opening in the SOI substrate; forming a second opening in the SOI substrate by etching the supporting layer and the second oxide film layer, the second opening connecting to the first opening to form the nozzle hole; forming a second liquid-phobic film on at least an inner surface defining the second opening in the SOI substrate; removing the first liquid-phobic film other than a portion of the first liquid-phobic film covering a portion of the inner surface defining the first opening corresponding to the first oxide film layer; and removing the second liquid-phobic film other than a portion of the second liquid-phobic film covering a portion of the inner surface defining the second opening corresponding to the second oxide film layer, wherein the first and second liquid-phobic films have liquid-phobicity, and the first liquid-phobic film has a surface energy lower than the second liquid-phobic film.

In this aspect of the present invention, the nozzle plate thus manufactured enables the position of the meniscus to be maintained in the range between the first liquid-phobic film and the second liquid-phobic film, by adjusting the pressure inside the nozzle hole. Consequently, it is possible to accurately control the position at which the meniscus of the liquid is maintained inside the nozzle hole, and it is possible to improve the ink droplet ejection characteristics.

According to the present invention, it is possible to provide a nozzle plate and a method of manufacturing a nozzle plate wherein the ink droplet ejection characteristics can be improved, by accurately controlling the meniscus position inside the nozzle.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
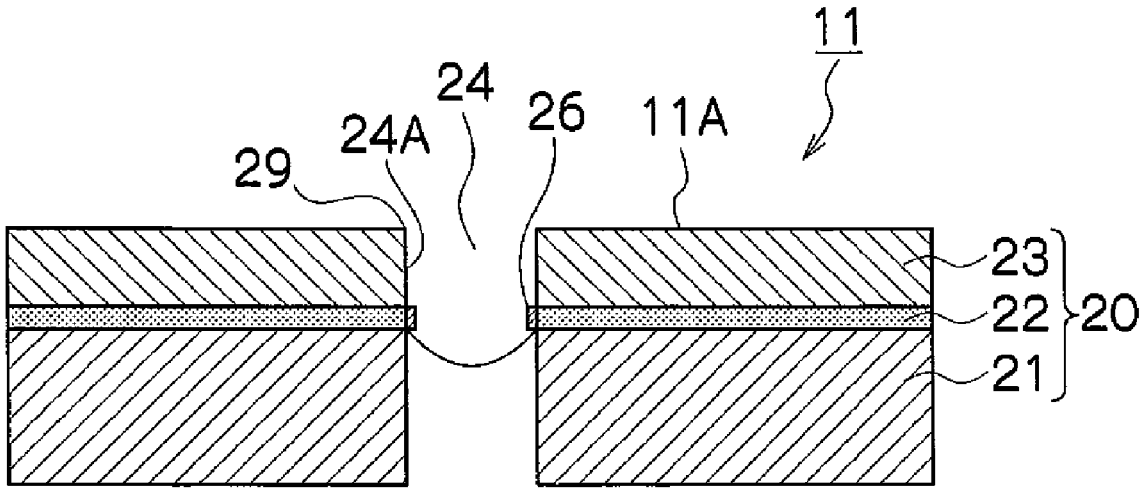
FIG. 1 is an enlarged view of the vicinity of a nozzle hole in a nozzle plate according to a first embodiment.

FIG. 1 is an enlarged view of the vicinity of a nozzle hole in a nozzle plate 11 according to a first embodiment. As shown in FIG. 1, the nozzle plate 11 according to the first embodiment is constituted of an SOI substrate 20 including a supporting layer 21, a box layer (oxide film layer) 22, and an active layer 23. The nozzle plate 11 is provided with a nozzle hole 24 through which ink droplets are ejected from the ejection surface (i.e., the surface of the active layer 23) of the nozzle plate 11. In other words, the nozzle plate 11 has a nozzle mouth 29 from which ink droplets are ejected, on the side of the active layer 23. One of the characteristic features of the present invention is that a liquid-phobic film 26, which has a shape of a band (ring), is formed about the whole circumference of the inner surface 24A defining the nozzle hole 24 in the portion corresponding to the box layer 22. The inner surface 24A defining the nozzle hole 24 is constituted of the surface of the active layer 23 having liquid-philic properties (corresponding to "first liquid-philic portion"), the surface composed of the band-shaped liquid-phobic film (also referred to as "ring-shaped liquid-phobic film") 26 having liquid-phobic properties (corresponding to "liquid-phobic portion"), and the surface of the supporting layer 21 having liquid-philic properties (corresponding to "second liquid-philic portion"). The first liquid-philic portion, the liquid-phobic portion and the second liquid-philic portion are arranged in this order from a side near the nozzle mouth 29, as shown in FIG. 1.

It is possible to form the first and second liquid-philic portions by liquid-philizing the inner surface defining the nozzle hole 24 including the portion corresponding to the active layer 23 and the portion corresponding to the supporting layer 21, in order to achieve stronger liquid-philic properties.

By means of the nozzle plate 11 according to the first embodiment, it is possible to accurately maintain the holding position of the ink meniscus at the position (more specifically, at the boundary between the band-shaped liquid-phobic film 26 and the supporting layer 21) of the band-shaped liquid-phobic film 26 which is separated from the nozzle mouth 29 of the nozzle hole 24 by the active layer 23, as shown in FIG. 1, and therefore the ink droplet ejection characteristics can be improved.

Figure 2A:
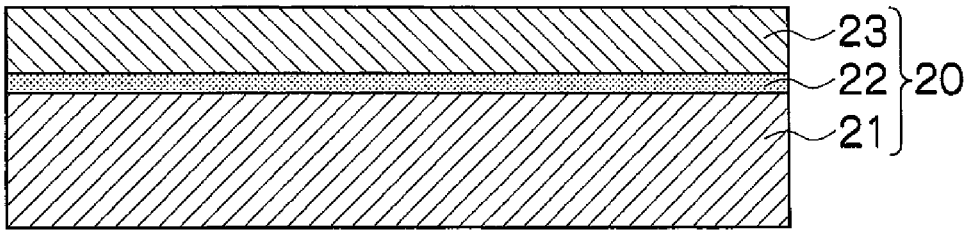
FIGS. 2A to 2D are diagrams showing a method of manufacturing the nozzle plate according to the first embodiment.

Here, the method of manufacturing the nozzle plate 11 according to the first embodiment will be described with reference to FIGS. 2A to 2D. Firstly, the SOI substrate 20 constituted of the supporting layer 21, the box layer 22, and the active layer 23 as shown in FIG. 2A is prepared.

Figure 2B:
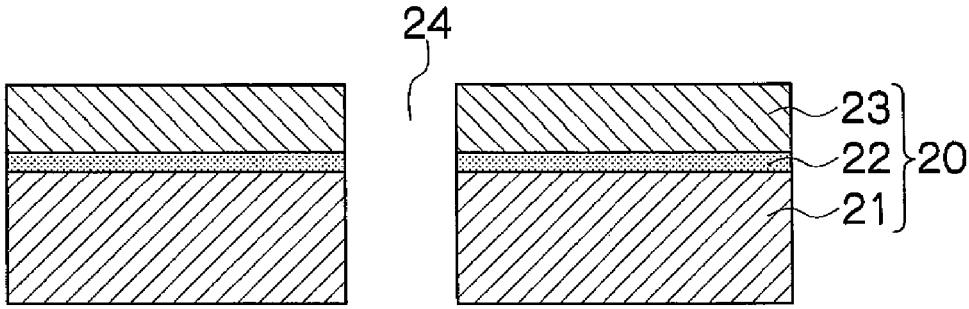

Thereupon, as shown in FIG. 2B, the nozzle holes 24 are formed by etching the SOI substrate 20 (nozzle forming step). More specifically, the front surface of the active layer 23 is coated with a photosensitive resin, and pre-baking, exposure, development and post-baking processes are then carried out in order to pattern the resist (not illustrated). The patterned resist is used to perform dry etching of the silicon of the active layer 23, the box layer 22, and the silicon of the supporting layer 21. Thereupon, the resist is removed by using a stripping agent. According to requirements, polymer removal may also be carried out.

Figure 2C:
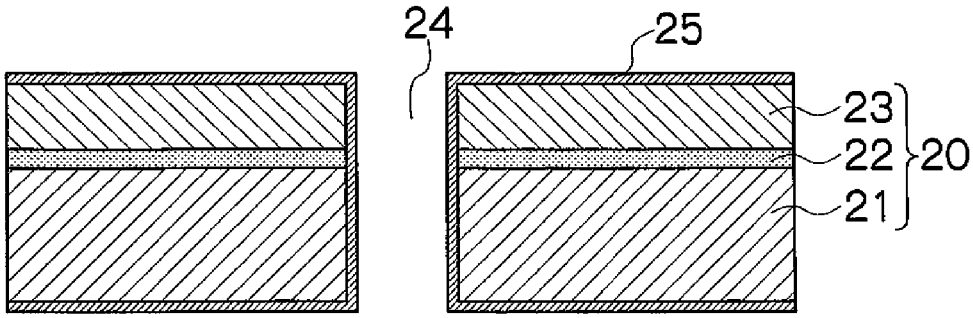

Thereupon, the nozzle plate 11 is liquid-phobized (liquid-phobic film forming step). More specifically, as shown in FIG. 2C, a liquid-phobic film 25 is formed over the whole surface of the SOI substrate 20 in which nozzle holes 24 have been formed. It is possible to use a method such as dip coating, spin coating, vapor processing, vapor deposition, CVD, or the like, in order to form the liquid-phobic film 25. Desirably, the liquid-phobic film 25 is a monomolecular film composed of a molecule including a fluorine group. For example, the liquid-phobic film 25 may be a monomolecular film composed of fluoroalkyl silane.

Figure 2D:
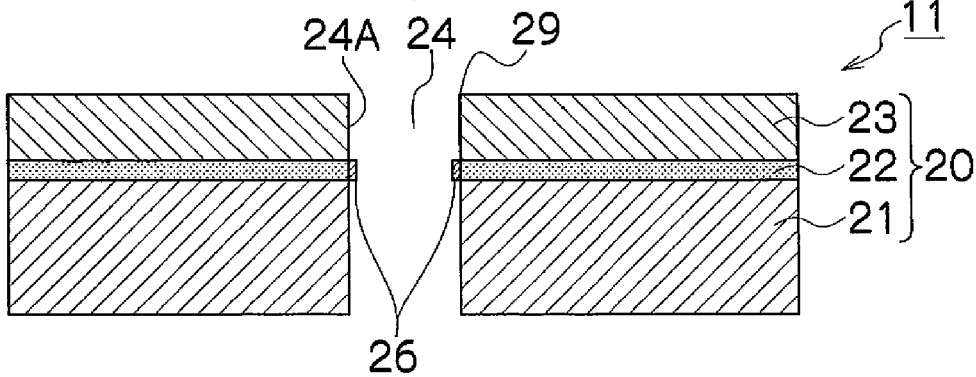

Thereupon, the substrate is washed with acetone, or the like (liquid-phobic film removal step). In this case, as shown in FIG. 2D, since the liquid-phobic film 25 has good adhesive characteristics on the box layer 22, then the liquid-phobic film on the box layer 22 is not removed and only the liquid-phobic film 25 adhering to portions other than the box layer 22 is removed. Consequently, the band-shaped liquid-phobic film 26 is formed on a portion of the inner surface defining the nozzle hole 24 corresponding to the box layer 22. If the liquid-phobic film 25 is deposited by vapor deposition, CVD, or the like, and the adhesion of the liquid-phobic film 25 to the SOI substrate 20 is high, thus making it difficult to remove the liquid-phobic film 25 by washing with acetone, or the like, then it is also possible to remove the liquid-phobic film 25 by radiating laser, ultraviolet light or ultraviolet light in a vacuum, onto the portions where the liquid-phobic film 25 is not required.

The nozzle plate 11 according to the first embodiment is manufactured by the process described above. Since the SOI substrate 20 of the nozzle plate 11 includes the supporting layer 21, the box layer 22 and the active layer 23 which are formed with good accuracy, then the band-shaped liquid-phobic film 26 is formed at a prescribed position with good accuracy. Moreover, the inner surface defining the nozzle hole 24 includes a portion corresponding to the band-shaped liquid-phobic film 26 and portions corresponding to the supporting layer 21 and the active layer 23, the portion corresponding to the liquid-phobic film 26 having liquid-phobic properties higher than the other portions corresponding to the supporting layer 21 and the active layer 23. Consequently, the position of the meniscus of the ink inside the nozzle hole 24 is maintained accurately at the position (and more specifically, at the boundary between the liquid-phobic film 26 and the supporting layer 21) of the band-shaped liquid-phobic film 26 which is separated from the nozzle mouth 29 by the active layer 23.

In the inner surface defining the nozzle hole 24, taking the surface energy of the supporting layer 21 to be Es2, taking the surface energy of the band-shaped liquid-phobic film 26 to be Eh, and taking the surface energy of the active layer 23 to be Es1, then it is desirable that the condition Es2≧Es1>Eh should be satisfied. By satisfying this condition, it is possible to maintain the meniscus of the ink inside the nozzle hole 24 at the position of the band-shaped liquid-phobic film 26 on the box layer 22. It is therefore possible to accurately control the holding position of the ink meniscus inside the nozzle hole 24, and hence the ink droplet ejection characteristics can be improved.

The supporting layer 21 and the active layer 23 in the SOI substrate 20 are typically made of the same material (e.g. silicon), and the surface energy Es2 of the supporting layer 21 is usually equal to the surface energy Es1 of the active layer 23, but it is possible to make the surface energy Es2 of the supporting layer 21 greater than the surface energy Es1 of the active layer 23 by liquid-philizing the surface of the supporting layer 21, for example.

Figure 3:
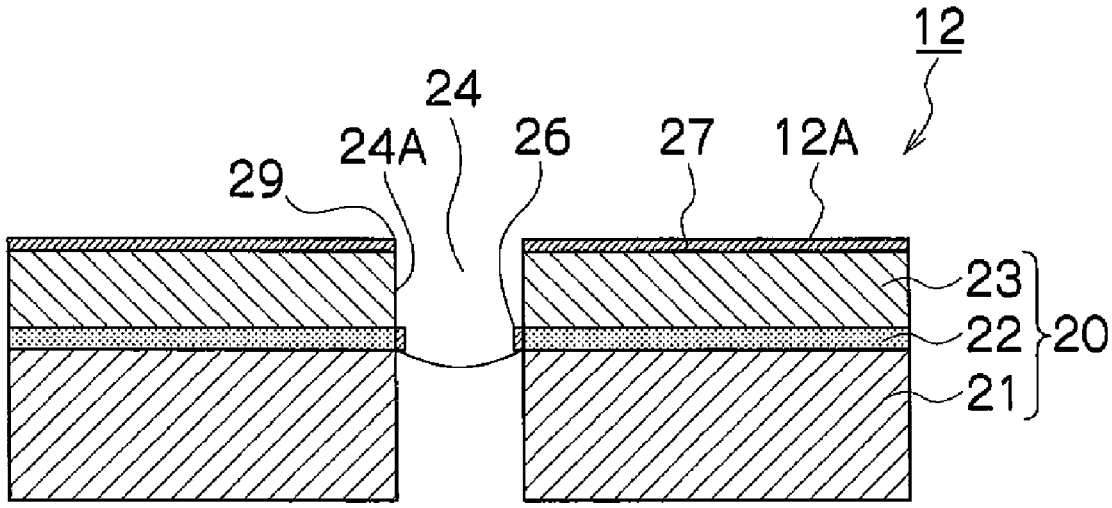
FIG. 3 is an enlarged diagram of the vicinity of the nozzle hole in a nozzle plate having a liquid-phobic film formed on the ejection surface.

Moreover, it is also possible to form the liquid-phobic film 27 on the ink ejection surface (12A, 13A) as well, as in a nozzle plate 12 shown in FIG. 3 and a nozzle plate 13 manufactured by a method shown in FIGS. 4A to 4F. A possible method of manufacturing the nozzle plate 12 shown in FIG. 3 is a method where, after the nozzle plate 11 is manufactured as described above, only the ink ejection surface 12A is liquid-phobized, while the interiors of the nozzle holes 24 are in a sealed state, or a method where an oxide film layer is formed only on the side of the ejection surface 12A, and the liquid-phobic film 27 is formed at the same time as the liquid-phobic film 26 is formed.

Figure 4A:
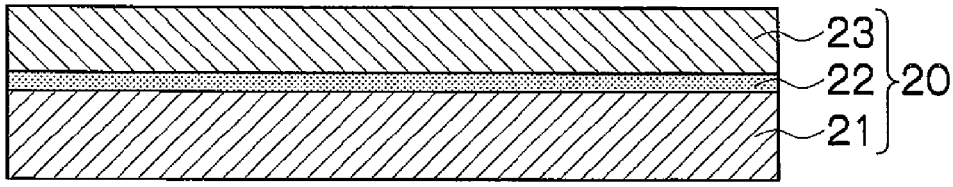
FIGS. 4A to 4E are enlarged views of the vicinity of the nozzle hole in a nozzle plate formed previously with an oxide film mask layer over the active layer.
Figure 4B:
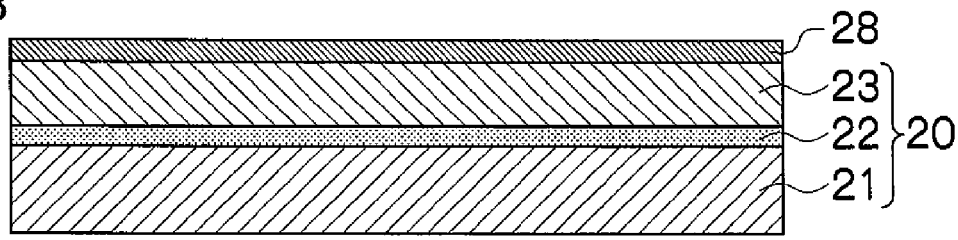
Figure 4C:
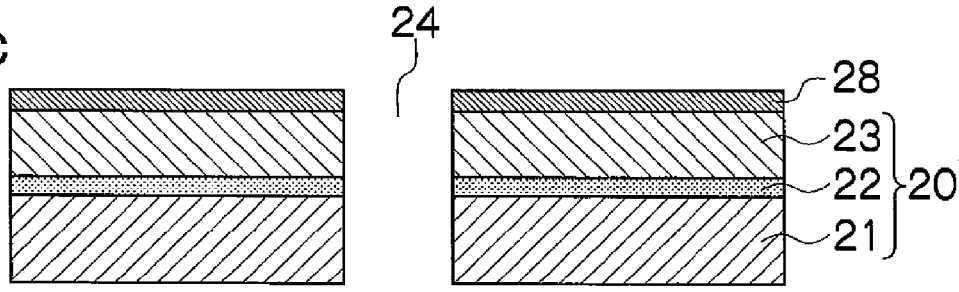
Figure 4D:
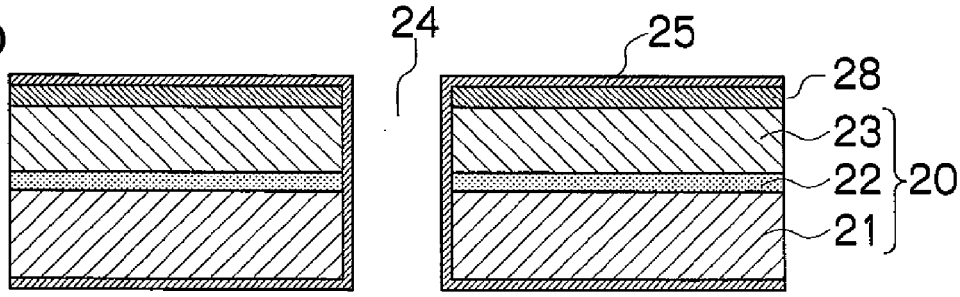
Figure 4E:
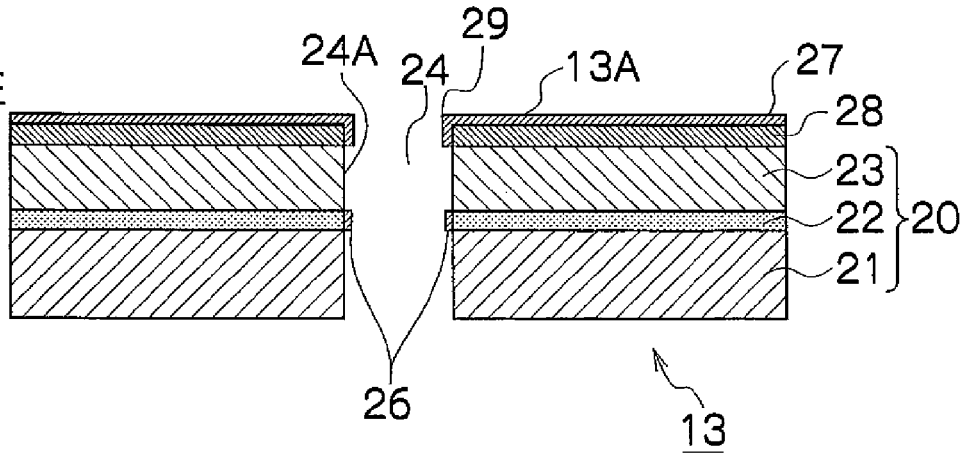

A possible method of manufacturing the nozzle plate 13 shown in FIGS. 4A to 4E is one where the nozzle plate 13 is liquid-phobized while using a mask layer 28. More specifically, the SOI substrate 20 is prepared as shown in FIG. 4A, an oxide film is formed previously over the active layer 23 as a mask layer 28 as shown in FIG. 4B, the nozzle holes 24 are formed by etching the SOI substrate 20 as shown in FIG. 4C, the liquid-phobic film 25 is formed over the whole surface of the SOI substrate 20 including the inner surface defining the nozzle hole 24 as shown in FIG. 4D, whereupon the band-shaped liquid-phobic film 26 is formed in the nozzle plate 13 in the portion corresponding to the box layer 22 inside each nozzle hole 24 as shown in FIG. 4E, by washing with acetone or the like, and the liquid-phobic film 27 is also formed on the ink ejection surface 13A and the portion inside each nozzle hole 24 which corresponds to the mask layer 28.

On the inner surface defining the nozzle holes 24, if the surface energy of the liquid-phobic film 27 is taken to be Eo, then it is desirable that the following relationship should be satisfied: (surface energy Es2 of supporting layer 21)≧(surface energy Es1 of active layer 23)>(surface energy Eh of band-shaped liquid-phobic film 26)≧(surface energy Eo of liquid-phobic film 27). By satisfying this condition, the surface of the band-shaped liquid-phobic film 26 has stronger liquid-phobic properties than the surface of the supporting layer 21 or the surface of the active layer 23. The ink meniscus inside the nozzle hole 24 is therefore maintained at the position of the band-shaped liquid-phobic film 26. Moreover, the liquid-phobic properties of the surface of the liquid-phobic film 27 on the ejection surfaces (12A, 13A) are stronger than those of the surface of the band-shaped liquid-phobic film 26. Therefore, even if the meniscus breaks down inside the nozzle hole 24 and the position of the meniscus moves from the position corresponding to the liquid-phobic film 26 to a position nearer to the nozzle mouth 29 (ejection surface), the ink is not liable to wet and spread onto the ejection surface (12A, 13A). Consequently, it is possible to improve the ink droplet ejection characteristics.

In the present embodiment, the liquid-phobic film 25 is formed over the whole surface of the SOI substrate 20 as shown in FIG. 2C, but the liquid-phobic film 25 may be formed only on the inner surface 24A defining the nozzle hole 24.

Second Embodiment

Figure 5:
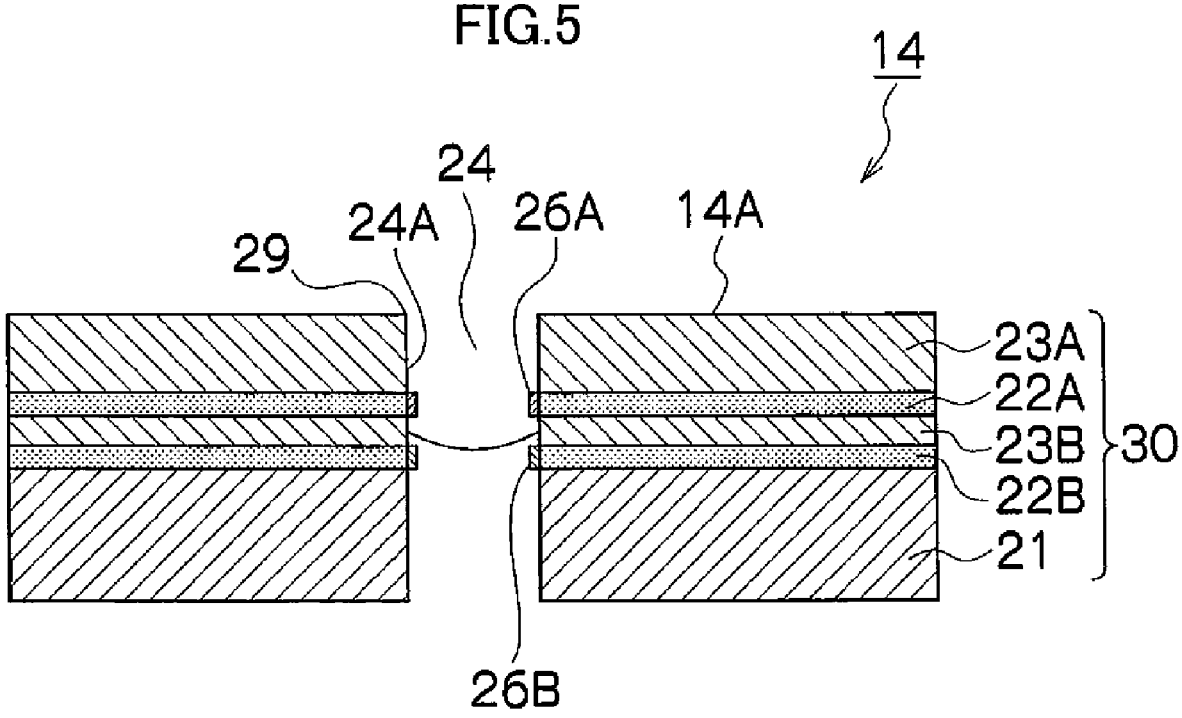
FIG. 5 is an enlarged view of the vicinity of a nozzle hole in a nozzle plate according to a second embodiment.

FIG. 5 is an enlarged view of the vicinity of a nozzle hole 24 formed through the nozzle plate 14 according to the second embodiment. As shown in FIG. 5, the nozzle plate 14 according to the second embodiment differs from the nozzle plate 1 according to the first embodiment in that two band-shaped liquid-phobic films (26A and 26B) are formed about the whole circumference of the inner surface 24A defining the nozzle hole 24. Moreover, the two band-shaped liquid-phobic films (26A and 26B) have mutually different surface energies, the surface energy of the band-shaped first liquid-phobic film 26A which is nearer to the nozzle mouth 29 (ink ejection surface 14A) being lower than that of the band-shaped second liquid-phobic film 26B which is farther from the nozzle mouth 29 (the ink ejection surface 14A).

When the position of the ink meniscus inside the nozzle hole 24 is controlled between the two band-shaped liquid-phobic films (26A and 26B) by adjusting the pressure inside the nozzle hole 24, by adopting the nozzle plate 14 according to the second embodiment as described above, then even if the meniscus is made to perform minute vibration in order to prevent problems such as blockages due to increased viscosity of the ink in the vicinity of the nozzle hole 24, it is still possible to confine the position of the meniscus in a range between the two band-shaped liquid-phobic films (26A and 26B). Furthermore, in a similar fashion, even if a negative pressure is applied to the ink inside the nozzle hole 24 by a liquid negative pressure apparatus, which is described hereinafter, in order to prevent ink from leaking out from the nozzle hole 24 when not performing ejection, it is still possible to maintain the position of the meniscus at a position between the two band-shaped liquid-phobic films (26A and 26B).

In order to maintain the position of the ink meniscus inside the nozzle hole 24 at a position between the two band-shaped liquid-phobic films (26A and 26B), the second liquid-phobic film 26B desirably has a surface energy of a prescribed level that achieves intended liquid-phobicity. More specifically, the second liquid-phobic film 26B desirably has a surface energy which allows the ink to wet and spread over the second liquid-phobic film 26B when an ink supply pressure is applied to the pressure chamber, which is described hereinafter, whereas the ink is prevented from wetting and spreading if the meniscus is made to perform minute vibration or if a negative pressure is applied to the ink inside the nozzle hole 24 by means of a liquid negative pressure device, which is described hereinafter.

Moreover, even in a case where pressure variations occur in the plurality of nozzle holes 24 when the nozzle plate is used in a fill line type of head, it is possible to maintain the position of the meniscus at a position between the two band-shaped liquid-phobic films (26A and 26B).

Figure 6A:
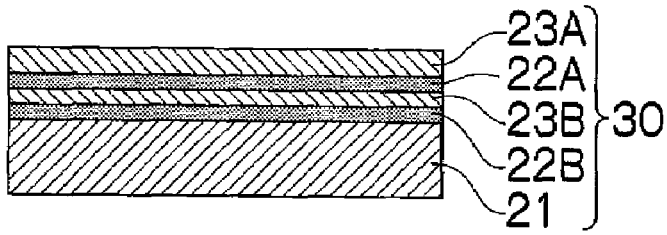
FIGS. 6A to 6I are diagrams showing a method of manufacturing a nozzle plate according to the second embodiment.
Figure 6B:
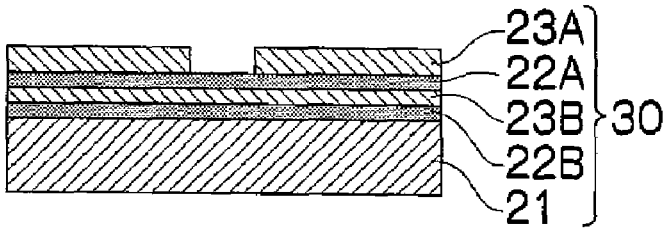
Figure 6C:
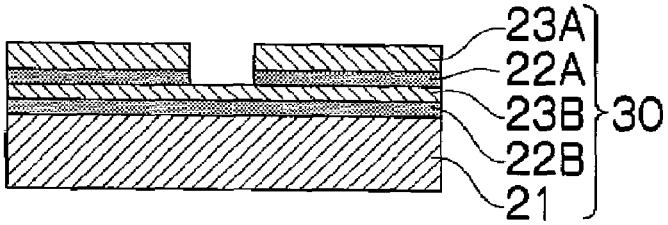
Figure 6D:
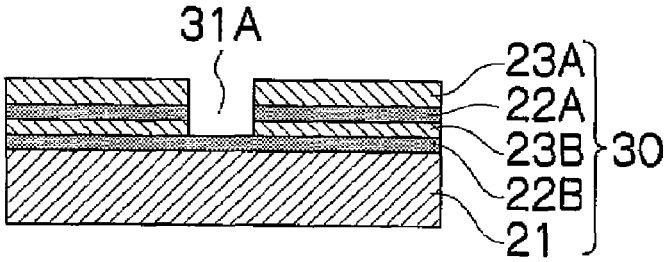

The method of manufacturing the nozzle plate 14 according to the second embodiment will now be described with reference to FIGS. 6A to 6I. Firstly, an SOI substrate 30, constituted of a first active layer 23A, a first box layer 22A (first oxide film layer), a second active layer 23B, a second box layer 22B (second oxide film layer) and a supporting layer 21, is prepared, as shown in FIG. 6A. The first active layer 23A made of silicon is subjected to dry etching, as shown in FIG. 6B, the first box layer 22A is then dry etched as shown in FIG. 6C, and the second active layer 23B is dry etched as shown in FIG. 6D, thereby obtaining a first opening section 31A (first opening section forming step).

Figure 6E:
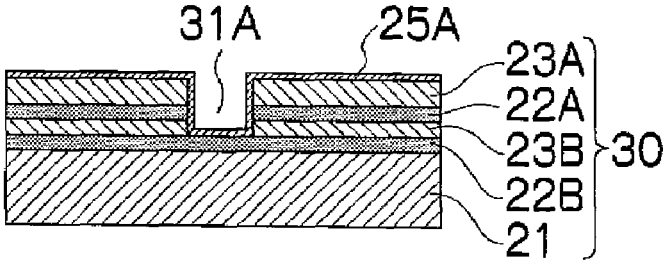
Figure 6F:
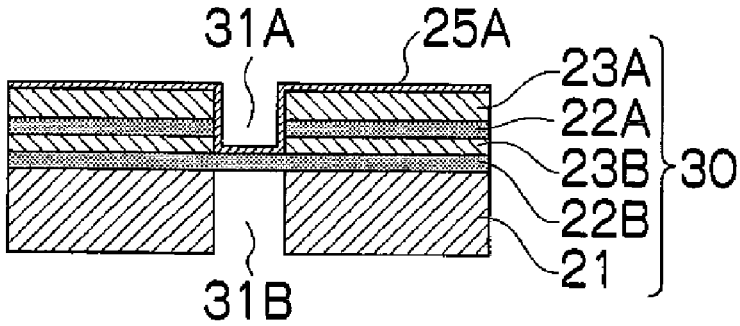
Figure 6G:
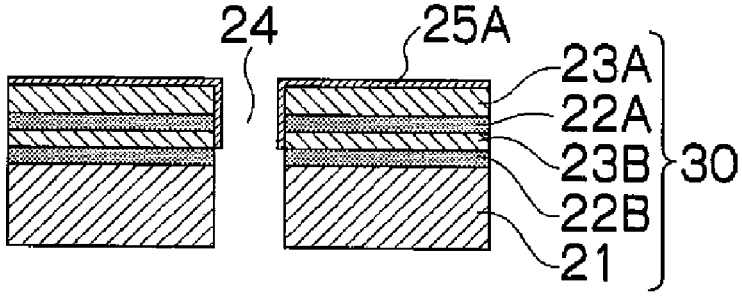

Thereupon, as shown in FIG. 6E, a liquid-phobic film 25A is formed on the surface of the SOI substrate 30, on the side where the first opening section 31A is provided. More specifically, the liquid-phobic film 25A is formed on the surface of the first opening section 31A and the first active layer 23A (the first opening section side liquid-phobic film forming step). Thereupon, as shown in FIGS. 6F and 6G, the supporting layer 21 and the second box layer 22B are dry etched and a second opening section 31B is formed (second opening section forming step). The nozzle hole 24 is thus formed passing through the first opening section 31A and the second opening section 31B.

Figure 6H:
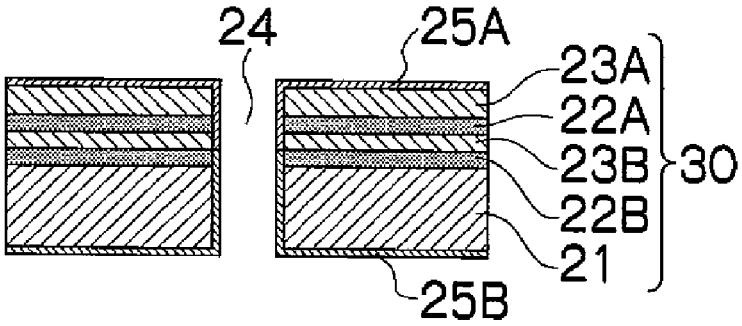

Subsequently, as shown in FIG. 6H, a liquid-phobic film 25B is formed on the surface of the SOI substrate 30 on which the liquid-phobic film 25A is not formed (second opening section side liquid-phobic film forming step). The liquid-phobic film 25A on the side of the first opening section 31A preferably has a surface energy lower than the liquid-phobic film 25B on the side of the second opening section 31B. If for example, fluoroalkyl silane is used as the material for both the liquid-phobic film 25A on the side of the first opening section 31A and the liquid-phobic film 25B on the side of the second opening section 31B, then a fluoroalkyl silane having a large number of fluorine groups and a relatively low surface energy (and hence a relatively low surface tension) is used for the liquid-phobic film 25A on the side of the first opening section 31A, and a fluoroalkyl silane having a small number of fluorine groups and a relatively high surface energy (and hence a relatively high surface tension) is used for the liquid-phobic film 25B on the side of the second opening section 31B.

Figure 6I:
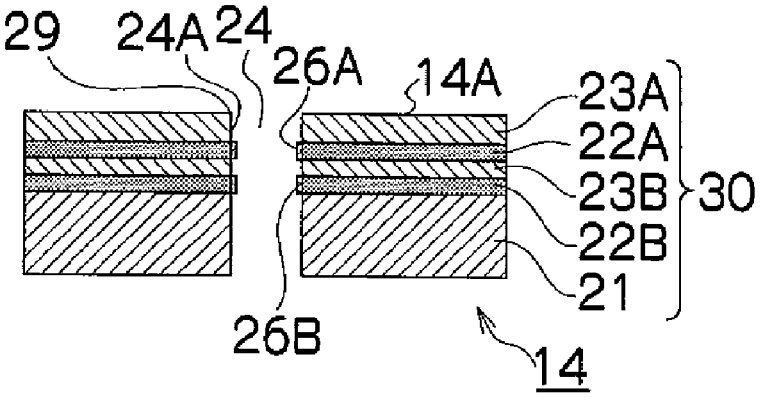

Thereupon, as shown in FIG. 6I, by removing the unwanted portions of the liquid-phobic films (25A and 25B) by washing with acetone, or the like, a band-shaped first liquid-phobic film 26A is formed inside the nozzle hole 24 in the portion corresponding to the first box layer 22A and a band-shaped second liquid-phobic film 26B is formed inside the nozzle hole 24 in the portion corresponding to the second box layer 22B (liquid-phobic film removal step). Similarly to the nozzle plate (12, 13) according to the first embodiment, it is also possible to form a liquid-phobic film on the ink ejection surface 14A as well.

The nozzle plate 14 according to the second embodiment can be manufactured by means of the above-described method.

Structure of the Head

Next, the structure of a head having the nozzle plate of the present invention will be described. The heads of the respective ink colors have the same structure, and a reference numeral 50 is hereinafter designated to any of the heads.

Figure 7A:
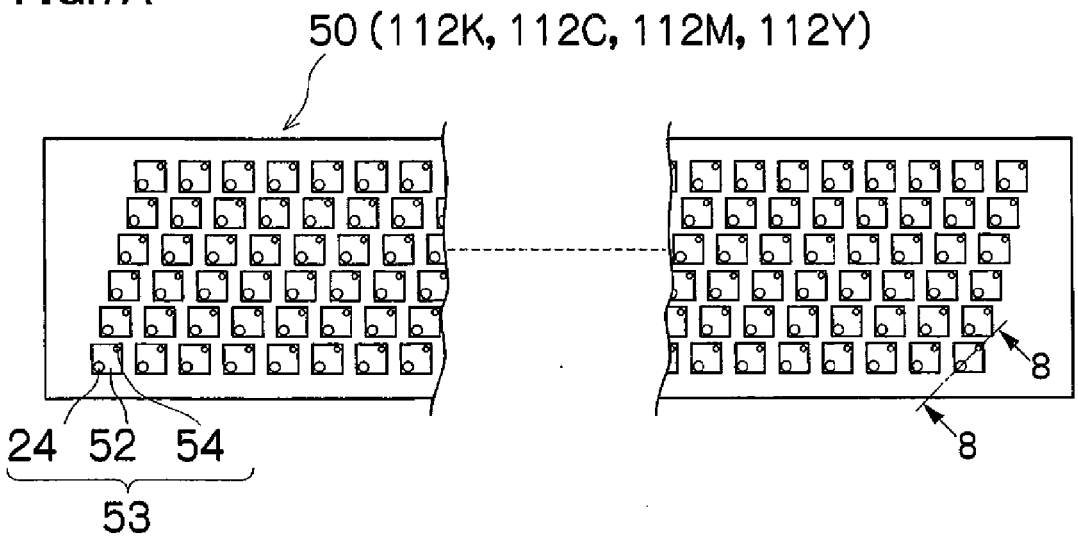
FIGS. 7A to 7C are plan perspective diagrams showing an example of the structure of a print head.
Figure 7B:
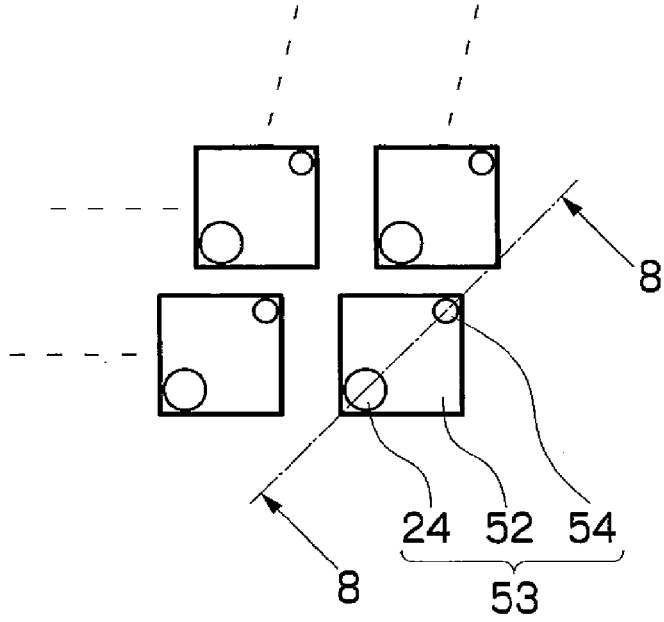
Figure 7C:
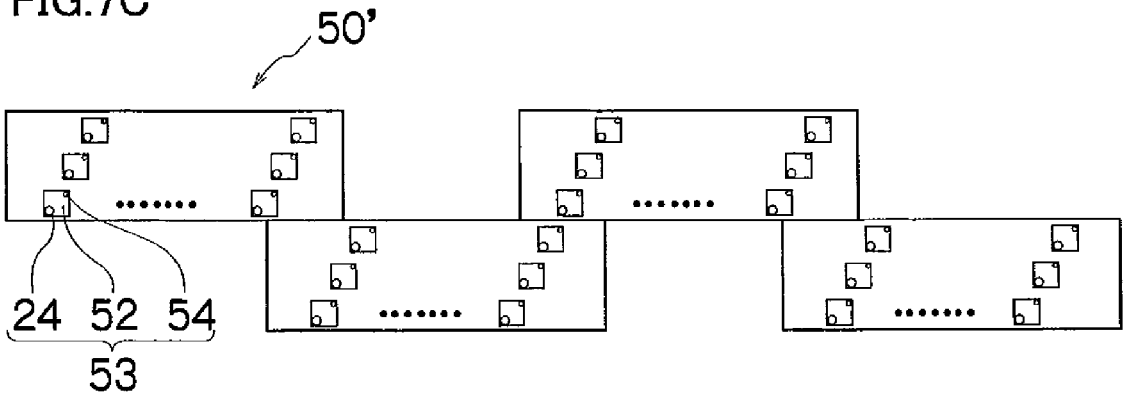
Figure 8:
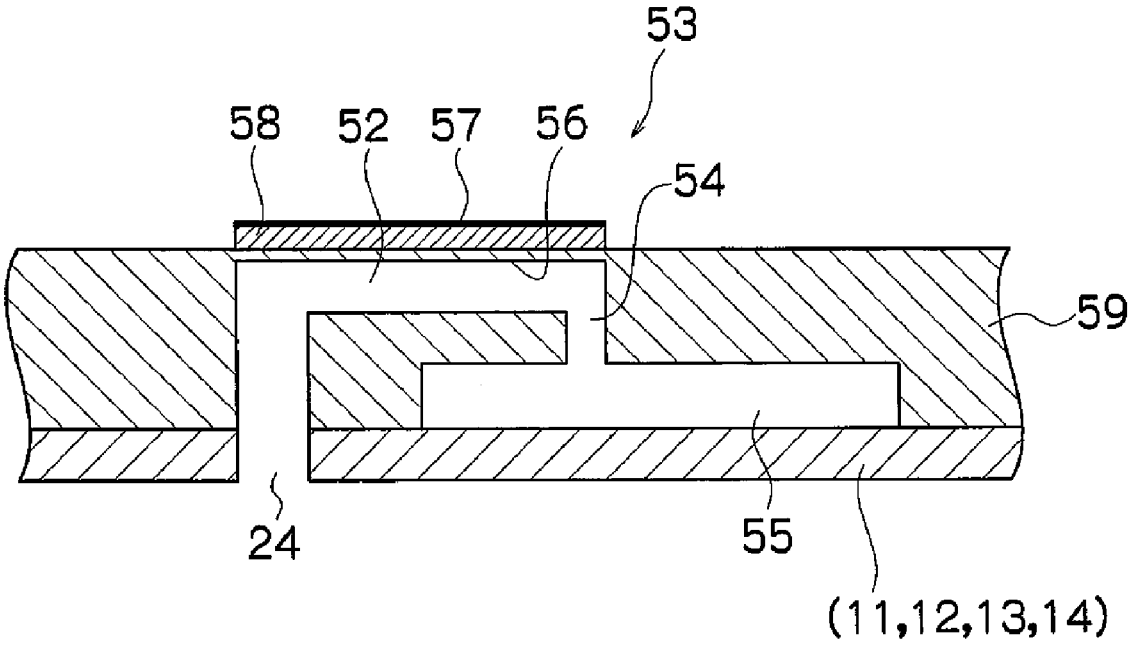
FIG. 8 is a cross-sectional diagram along line 8-8 in FIGS. 7A and 7B.

FIG. 7A is a perspective plan view showing an example of the configuration of the head 50, FIG. 7B is an enlarged view of a portion thereof, FIG. 7C is a perspective plan view showing another example of the configuration of the head 50, and FIG. 8 is a cross-sectional view taken along the line 8-8 in FIGS. 7A and 7B, showing the inner structure of a droplet ejection element (an ink chamber unit for one nozzle hole 24).

The nozzle pitch in the head 50 should be minimized in order to maximize the density of the dots printed on the surface of the recording paper. As shown in FIGS. 7A and 7B, the head 50 according to the present embodiment has a structure in which a plurality of ink chamber units (droplet ejection elements) 53, each comprising a nozzle hole 24 forming an ink ejection port, a pressure chamber 52 corresponding to the nozzle hole 24, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper in a direction substantially perpendicular to the conveyance direction of the recording paper is not limited to the example described above. For example, instead of the configuration in FIG. 7A, as shown in FIG. 7C, a line head having nozzle rows of a length corresponding to the entire width of the recording paper can be formed by arranging and combining, in a staggered matrix, short head module 50' having a plurality of nozzle holes 24 arrayed in a two-dimensional fashion.

As shown in FIGS. 7A and 7B, the planar shape of the pressure chamber 52 provided for each nozzle hole 24 is substantially a square, and an outlet to the nozzle hole 24 is provided at one side of two corners and an inlet of supplied ink (supply port) 54 is provided at the other side of the corners on a diagonal line of the square.

The shape of the pressure chamber 52 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 8, the head 50 includes one of the nozzle plates (11, 12, 13, 14), which are described above, and a flow channel substrate 59. Thereupon, pressure chambers 52, supply ports 54, a common flow channel 55, and the like, are formed in the flow channel substrate 59. Each pressure chamber 52 is connected to a common channel 55 through the supply port 54. The common channel 55 is connected to an ink tank (not shown), which is a base tank that supplies ink, and the ink supplied from the ink tank is delivered through the common flow channel 55 to the pressure chambers 52.

An actuator 58 provided with an individual electrode 57 is bonded to a pressure plate (a diaphragm that also serves as a common electrode) 56 which forms the surface of one portion (in the FIG. 8, the ceiling) of the pressure chamber 52. When a drive voltage is applied to the individual electrode 57 and the common electrode, the actuator 58 is deformed, the volume of the pressure chamber 52 is thereby changed, and the pressure in the pressure chamber 52 is thereby changed, so that the ink inside the pressure chamber 52 is thus ejected through the nozzle hole 24. For the actuator 58, it is possible to adopt a piezoelectric element using a piezoelectric body, such as lead zirconate titanate, barium titanate, or the like. When the displacement of the actuator 58 returns to its original position after ejecting ink, the pressure chamber 52 is replenished with new ink from the common flow channel 55, via the supply port 54.

Figure 9:
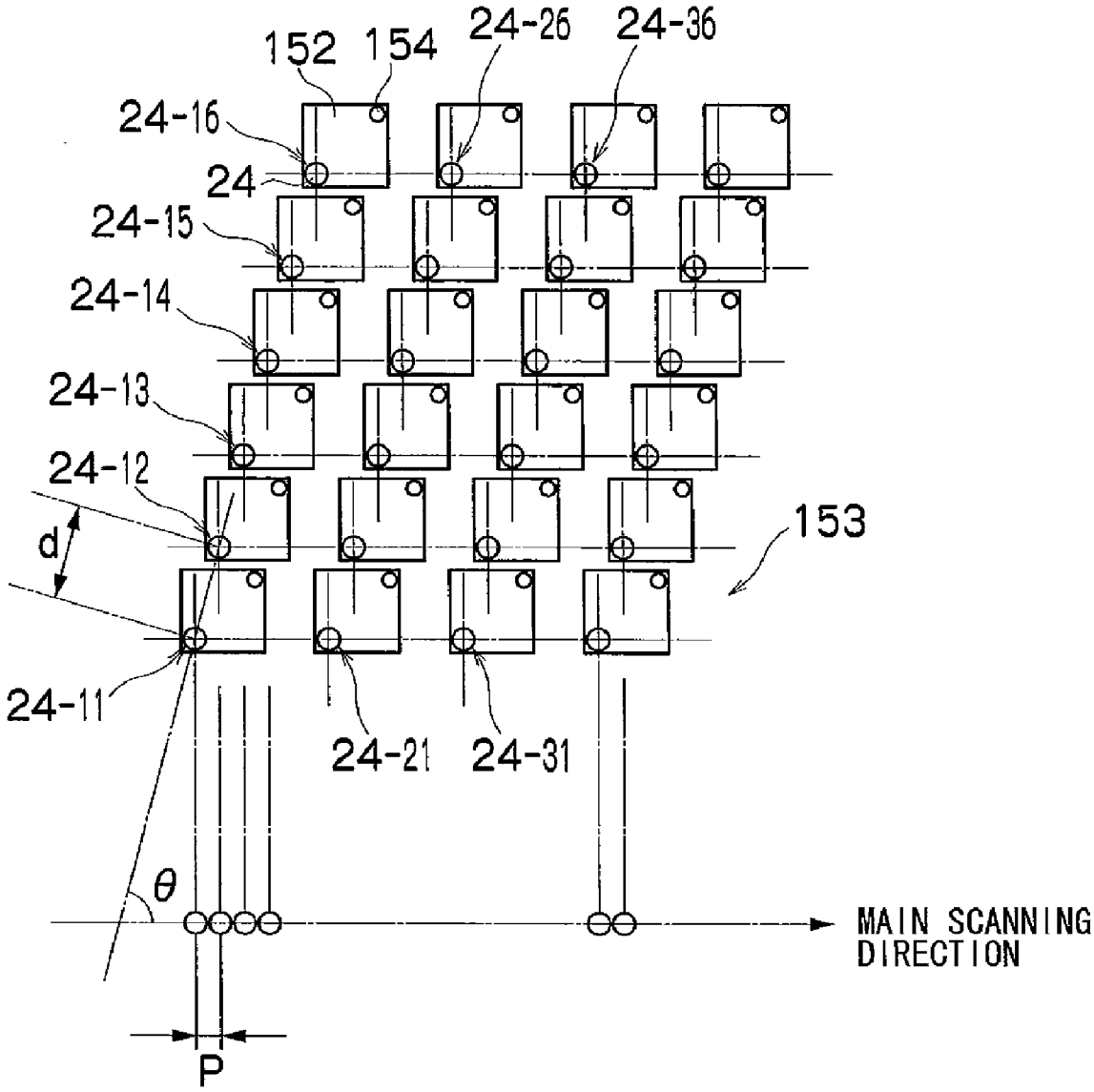
FIG. 9 is a detail diagram showing an enlarged view of a portion of the print head shown in FIGS. 7A to 7C.

As shown in FIG. 9, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzle holes 24 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzle holes 24 arranged in a matrix such as that shown in FIG. 9 are driven, the main scanning according to the above-described (3) is preferred. More specifically, the nozzle holes 24-11, 24-12, 24-13, 24-14, 24-15 and 24-16 are treated as a block (additionally; the nozzle holes 24-21, 24-22, . . . , 24-26 are treated as another block; the nozzle holes 24-31, 24-32, . . . , 24-36 are treated as another block; . . . ); and one line is printed in the width direction of the recording paper by sequentially driving the nozzle holes 24-11, 24-12, . . . , 24-16 in accordance with the conveyance velocity of the recording paper.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper is called the sub-scanning direction and the direction perpendicular to same is called the main scanning direction.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Composition of Inkjet Recording Apparatus

Next, an inkjet recording apparatus is described as a concrete example of the application of an image recording apparatus comprising the head described above.

Figure 10:
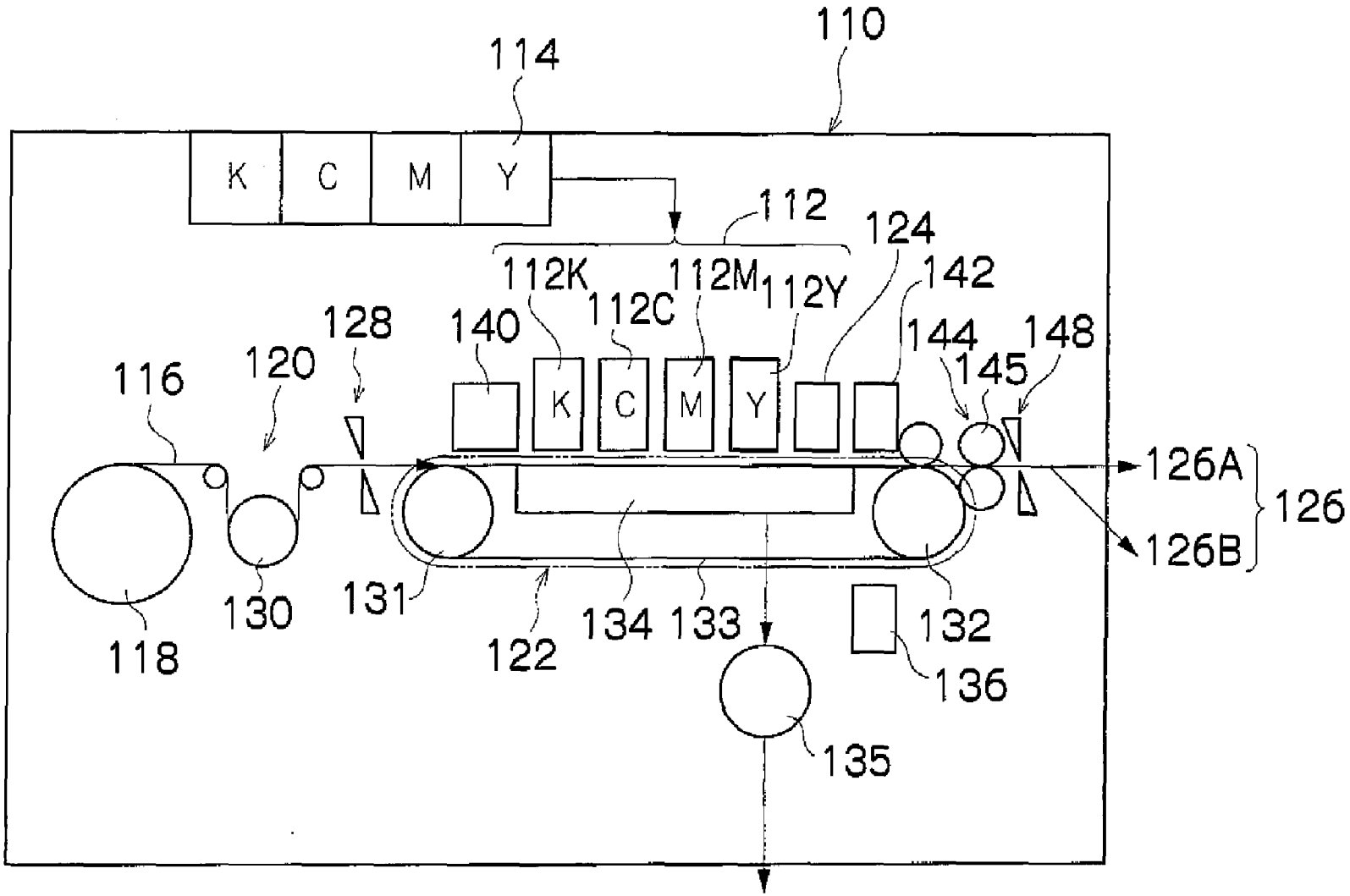
FIG. 10 is a general schematic drawing of an inkjet recording apparatus forming an image forming apparatus according to an embodiment of the present invention.

FIG. 10 is a general schematic drawing of an inkjet recording apparatus showing one embodiment for the image recording apparatus of the present invention. As shown in FIG. 10, the inkjet recording apparatus 110 comprises: a print unit 112 having a plurality of inkjet heads (hereafter, called "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the print heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink-droplet ejection face) of the print unit 112, for conveying the recording paper 116 while keeping the recording paper 116 flat; a print determination unit 124 for reading the printed result produced by the print unit 112; and a paper output unit 126 for outputting image-printed recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels.

In order to prevent ink from leaking out from the nozzle holes 24 provided in the heads 112K, 112C, 112M and 112Y when not performing ejection, it is possible to provide a liquid negative pressure apparatus which applies a negative pressure to the ink inside the nozzle holes 24. This liquid negative pressure apparatus is provided with a negative pressure generating chamber which, in order to apply a negative pressure, generates a negative pressure in the ink storage and loading unit 114 connected to the nozzle holes 24 (for example, an ink cartridge, an ink tank, a sub tank, or the like), by performing pressure adjustment by supplying or expelling air by means of a pump (not illustrated).

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 10, and the continuous paper is cut into a desired size by the cutter 128.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the print unit 112 and the sensor face of the print determination unit 124 forms a horizontal plane (flat plane).

Figure 11:
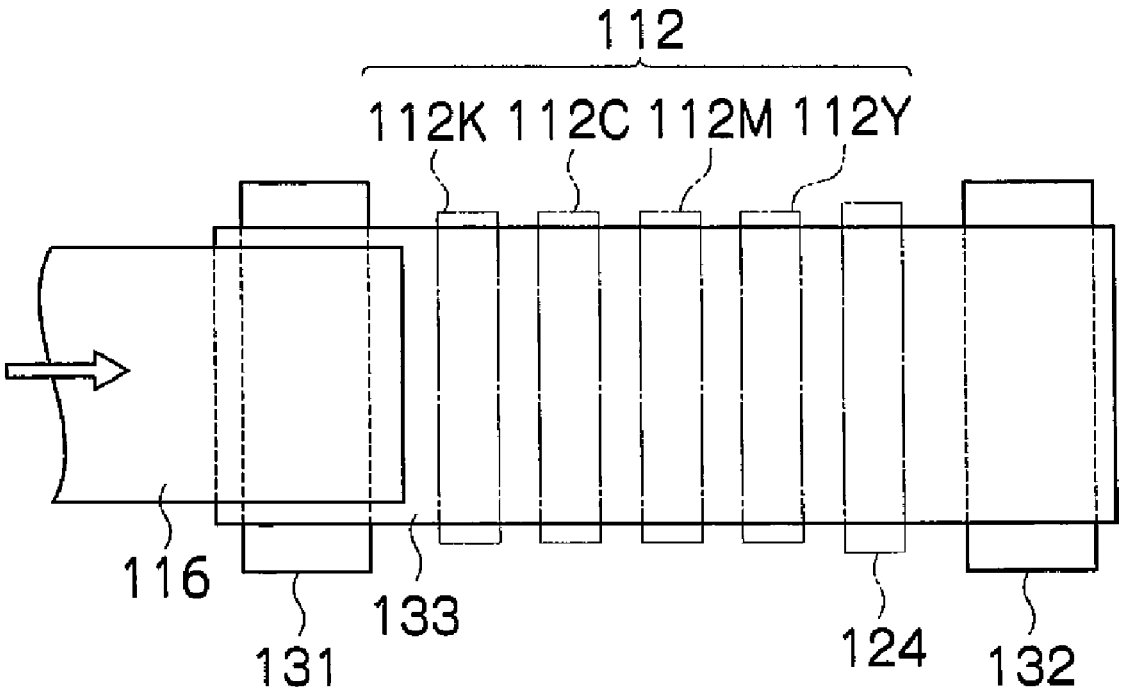
FIG. 11 is a plan view of the principal part of the peripheral area of a print unit in the inkjet recording apparatus illustrated in FIG. 10.

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the print unit 112 on the interior side of the belt 133, which is set around the rollers 131 and 132, as shown in FIG. 11. The suction chamber 134 provides suction with a fan 135 to generate a negative pressure, and the recording paper 116 is held on the belt 133 by suction.

The belt 133 is driven in the clockwise direction in FIG. 10 by the motive force of a motor 88 (not shown in FIG. 1, but shown in FIG. 12) being transmitted to at least one of the rollers 131 and 132, which the belt 133 is set around, and the recording paper 116 held on the belt 133 is conveyed from left to right in FIG. 10.

Since ink adheres to the belt 133 when a marginless print job or the like is performed, a belt-cleaning unit 136 is disposed in a predetermined position (a suitable position outside the printing area) on the exterior side of the belt 133.

A heating fan 140 is disposed on the upstream side of the print unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

The heads 112K, 112C, 112M and 112Y of the print unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 11).

The print heads 112K, 112C, 112M and 112Y are arranged in color order (black (K), cyan (C), magenta (M), yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the print unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. Furthermore, there are no particular restrictions of the sequence in which the heads of respective colors are arranged.

The print determination unit 124 shown in FIG. 10 has an image sensor (line sensor or area sensor) for capturing an image of the ink-droplet deposition result of the print unit 112, and functions as a device to check for ejection characteristics such as clogs of the nozzles or ink landing position deviation checked by images of the ink-droplet deposition results read from the image sensor.

A CCD area sensor in which a plurality of photoreceptor elements (photoelectric transducers) are arranged two-dimensionally on the light receiving surface is suitable for use as the print determination unit 124 of the present example. An area sensor has an imaging range which is capable of capturing an image of at least the full area of the ink ejection width (image recording width) of the respective heads 112K, 112C, 112M and 112Y.

A post-drying unit 142 is disposed following the print determination unit 124. The post-drying unit 142 is a device to dry the printed image surface, and includes a heating fan, for example.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted firm the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148.

Description of Control System

Figure 12:
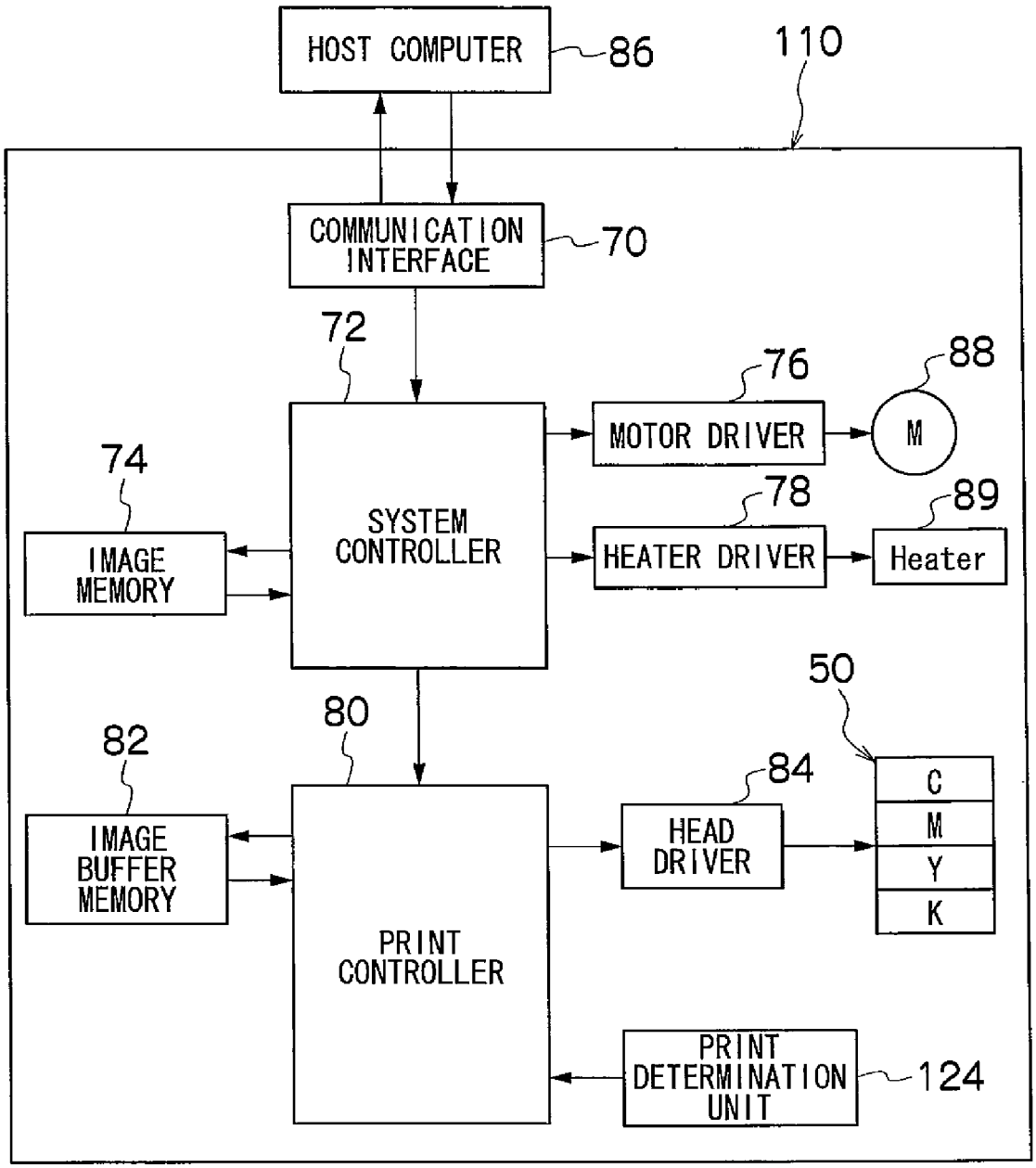
FIG. 12 is a principal block diagram showing the system configuration of the inkjet recording apparatus according to the present embodiment.
Figure 13:
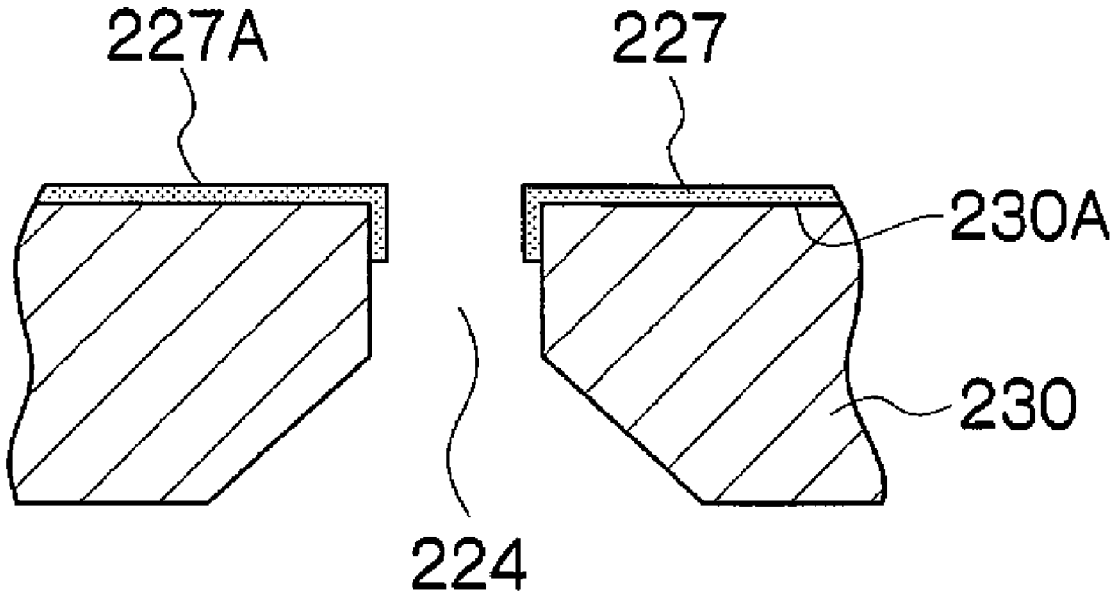
FIG.13 RELATED ART
FIG. 13 is an enlarged view of the principal part of a nozzle plate in the related art.
Figure 14A:
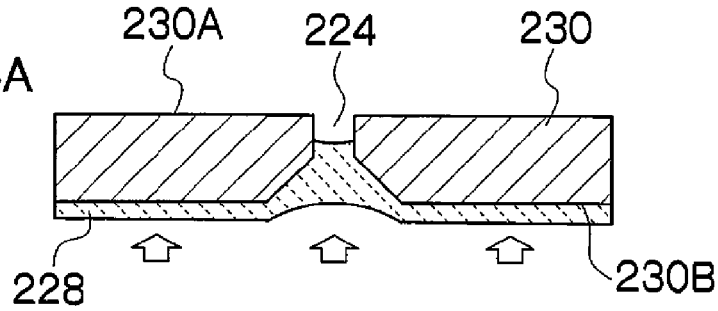
RELATED ART FIG.14A
FIGS. 14A to 14D are diagrams showing a method of manufacturing a nozzle plate in the related art.
Figure 14B:
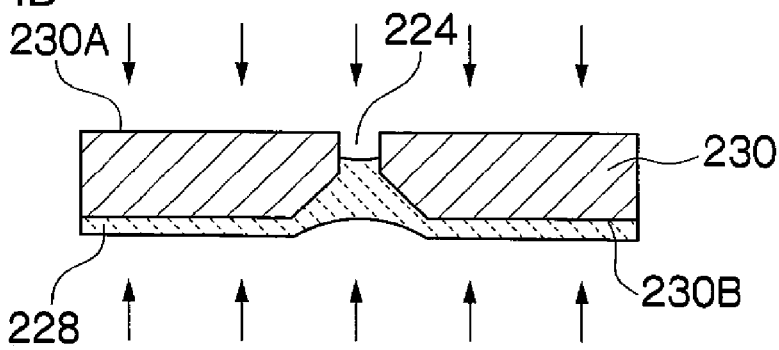
RELATED ART FIG.14B
Figure 14C:
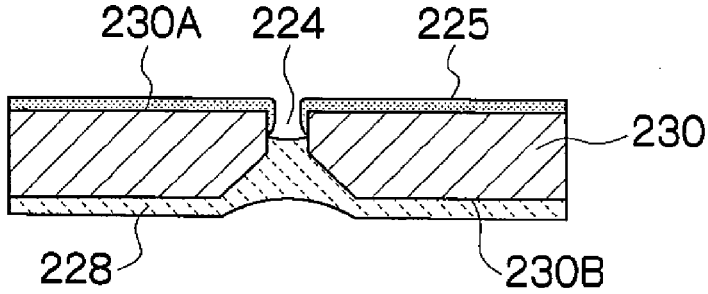
RELATED ART FIG.14C
Figure 14D:
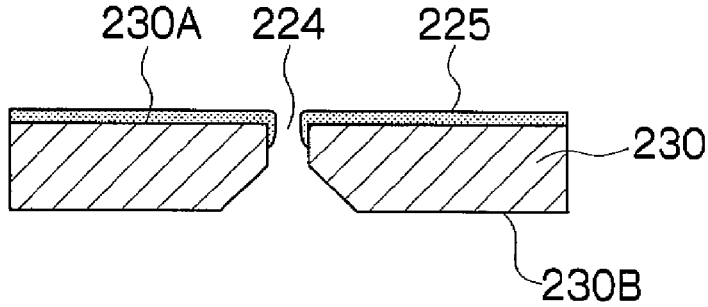
RELATED ART FIG.14D

FIG. 12 is a block diagram showing the system configuration of the inkjet recording apparatus 110. As shown in FIG. 12, the inkjet recording apparatus 110 comprises a communication interface 70, a system controller 72, an image memory 74, a motor driver 76, a heater driver 78, a print controller 80, an image buffer memory 82, a head driver 84, and the like.

The communication interface 70 is an interface unit (image input unit) which functions as an image input device for receiving image data sent from a host computer 86. A serial interface such as USB (Universal Serial Bus), IEEE1394, Ethernet (registered tradename), wireless network, or a parallel interface such as a Centronics interface may be used as the communication interface 70.

The image data sent from the host computer 86 is received by the inkjet recording apparatus 110 through the communication interface 70, and is temporarily stored in the image memory 74. The image memory 74 is a storage device for storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the post-drying unit 42 or the like in accordance with commands from the system controller 72.

The print controller 80 is a control unit which functions as a signal processing device for performing various treatment processes, corrections, and the like, in accordance with the control implemented by the system controller 72, in order to generate a signal for controlling droplet ejection from the image data (multiple-value input image data) in the image memory 74, as well as functioning as a drive control device which controls the ejection driving of the head 50 by supplying the ink ejection data thus generated to the head driver 84.

The print controller 80 is provided with the image buffer memory 82; and image data, parameters, and other data are temporarily stored in the image buffer memory 82 when image data is processed in the print controller 80. The aspect shown in FIG. 12 is one in which the image buffer memory 82 accompanies the print controller 80; however, the image memory 74 may also serve as the image buffer memory 82. Also possible is an aspect in which the print controller 80 and the system controller 72 are integrated to form a single processor.

To give a general description of the sequence of processing from image input to print output, image data to be printed (original image data) is input from an external source via a communication interface 70, and is accumulated in the image memory 74. At this stage, multiple-value RGB image data is stored in the image memory 74, for example.

The head driver 84 outputs a drive signal for driving the actuators 58 corresponding to the nozzle holes 24 of the head 50 in accordance with the print contents, on the basis of the ink ejection data and the drive waveform signals supplied by the print controller 80. The head driver 84 can be provided with a feedback control system for maintaining constant drive conditions for the print heads.

Hence, by supplying the drive signals output by the head driver 84 to the head 50, ink is ejected from the corresponding nozzle holes 24. By controlling ink ejection from the heads 50 in synchronization with the conveyance velocity of the recording paper 116, an image is formed on the recording paper 116.

As described above, the ejection volume and the ejection timing of the ink droplets from the respective nozzles are controlled via the head driver 84, on the basis of the ink ejection data generated by implementing prescribed signal processing in the print controller 80, and the drive signal waveform. By this means, prescribed dot sizes and dot positions can be achieved.

The print determination unit 124 is a block that includes the image sensor as described above with reference to FIG. 10, reads the image printed on the recording paper 116, determines the print conditions (presence of the ejection, variation in the dot formation, optical density, and the like) by performing desired signal processing, or the like, and provides the determination results of the print conditions to the print controller 180 and the system controller 72.

According to requirements, the print controller 80 implements various corrections with respect to the head 50, on the basis of the information obtained from the print determination unit 124, and implements control for carrying out cleaning operations (nozzle restoring operations), such as preliminary ejection, suctioning, or wiping, as and when necessary.

The nozzle plate, the method of manufacturing a nozzle plate, and the image forming apparatus according to the present invention have been described in detail above, but the present invention is not limited to the aforementioned examples, and it is of course possible for improvements or modifications of various kinds to be implemented, within a range which does not deviate from the essence of the present invention.

For example, the nozzle plate according to the present invention is not limited to use in an image forming apparatus and can also be used in a liquid ejection apparatus.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nozzle plate having a nozzle hole formed through the nozzle plate, the nozzle hole having a nozzle mouth from which a liquid is ejected, the nozzle hole being defined in the nozzle plate with an inner surface including a first liquid-philic portion, a liquid-phobic portion and a second liquid-philic portion that are arranged in this order from a side near the nozzle mouth, the first and second liquid-philic portions having liquid-philicity, the liquid-phobic portion having liquid-phobicity.

2. The nozzle plate as defined in claim 1, wherein:

the nozzle plate is constituted of an SOI substrate including a supporting layer, an active layer, and an oxide film layer interposed between the supporting layer and the active layer;

a portion of the inner surface defining the nozzle hole corresponding to the active layer serves as the first liquid-philic portion;

a portion of the inner surface defining the nozzle hole corresponding to the oxide film layer is covered with a liquid-phobic member that serves as the liquid-phobic portion;

a portion of the inner surface defining the nozzle hole corresponding to the supporting layer serves as the second liquid-philic portion; and a surface energy Es1 of the first liquid-philic portion, a surface energy Eh of the liquid-phobic portion and a surface energy Es2 of the second liquid-philic portion have a relationship of Es2≧Es1>Eh.

3. The nozzle plate as defined in claim 1, wherein a liquid-phobic film is formed on a surface of the nozzle plate on which the nozzle mouth opens, the liquid-phobic film having liquid-phobicity.

4. The nozzle plate as defined in claim 3, wherein a surface energy Es1 of the first liquid-philic portion, a surface energy Eh of the liquid-phobic portion, a surface energy Es2 of the second liquid-philic portion and a surface energy Eo of the liquid-phobic film on the ejection surface have a relationship of Es2≧Es1>Eh≧Eo.

5. The nozzle plate as defined in claim 1, wherein:

the inner surface defining the nozzle hole includes a plurality of the liquid-phobic portions; and one of the liquid-phobic portions which is nearest to the nozzle mouth has a surface energy lower than any other of the liquid-phobic portions.

6. An image forming apparatus comprising the nozzle plate as defined in claim 1.

* * * * *